United States Patent [19]

Wireman

[11] 4,075,617

[45] Feb. 21, 1978

[54] ALARM CIRCUIT FOR MONITORING REMOVAL OF PLUG FROM ELECTRICAL POWER RECEPTACLE

[76] Inventor: Wallace H. Wireman, 13 Park Ave., Walton, Ky. 41094

[21] Appl. No.: 686,789

[22] Filed: May 17, 1976

[51] Int. Cl.[2] ..... G08B 13/14

[52] U.S. Cl. ..... 340/280; 200/51.1

[58] Field of Search ..... 340/280; 200/51.1

[56] References Cited

U.S. PATENT DOCUMENTS

| | | | |
|---|---|---|---|
| 3,090,948 | 5/1963 | Cremer | 340/280 |
| 3,408,643 | 10/1968 | Sliman | 340/280 |
| 3,411,150 | 11/1968 | Schulein | 340/280 |
| 3,786,502 | 1/1974 | Stendig et al. | 340/280 |

*Primary Examiner*—Glen R. Swann, III

*Attorney, Agent, or Firm*—Melville, Strasser, Foster & Hoffman

[57] ABSTRACT

An alarm circuit for deterring the theft of electrical devices of the type normally plugged into an electrical power receptacle by providing an alarm signal whenever the electrical plug associated with the electrical device has been removed from the receptacle. The alarm circuit comprises an electrical power receptacle having hot, neutral and ground female contacts adapted to receive an electrical plug having corresponding electrical contacts, the receptacle also including a switch for connecting the neutral conductor to the ground conductor upon insertion of at least one of the male contacts associated with the plug. An indicating circuit in association with the receptacle provides an alarm signal when the electrical plug is removed from the receptacle.

12 Claims, 10 Drawing Figures

ALARM CIRCUIT FOR MONITORING REMOVAL OF PLUG FROM ELECTRICAL POWER RECEPTACLE

BACKGROUND OF THE INVENTION

This invention relates generally to alarm systems and more particularly to anti-theft alarm systems for monitoring the disposition of electrical devices of the type normally plugged into a wall A.C. electrical power outlet.

There currently exists a need for a reliable, inexpensive and versatile alarm system for monitoring the disposition of electrical appliances, particularly of the variety which are normally plugged into a wall A.C. electrical power outlet. For example, the motel industry has in recent years experienced a significant increase in vandalism which, to a large extent, has been directed at television receiver's provided by motels for viewing by motel guests. Although various measures have been taken by the motel industry to safeguard television receivers, these efforts have not been altogether satisfactory. For example, various means have been devised to securely fasten the television receiver chassis to other objects whose theft is considered likely. However, various ingenious techniques have been developed to thwart such safeguards. Furthermore, it will be appreciated that the use of security personnel to constantly patrol the typically appreciable extent of motel property is a highly impractical solution to the problem.

In order to provide motel proprietors with some degree of theft protection, there are presently available various types of alarm systems for monitoring unauthorized disturbances of property such as television receivers. For example, means are known in the prior art which attach directly to a television receiver and provide an alarm in response to any unauthorized movement thereof. Devices of this type are generally largely electronic in nature and exhibit various disadvantages in connection with their practical implementation. Among others, these disadvantages include high per unit cost, a rather delicate construction and, frequently, insufficient reliability. Furthermore, prior art alarm systems of the motion responsive type frequently require delicate adjustments and include sensors which do not adequately respond to motion in all directions.

As previously mentioned, prior art alarm systems whose primary purpose is that of protecting relatively easily movable property are most frequently of the type which directly attach to the property under consideration. Therefore, to be useful at all, prior art alarm systems of this variety are normally self-contained units operable from a portable power supply such as one or more batteries, and must be individually associated with each item of property to be protected. These characteristics pose several problems. Initially, there is the problem of reliability associated with battery operated equipment. Either the batteries must be replaced in a regular manner or, alternatively, a maintenance schedule must be established for periodically testing the battery charge. In either event, considerable time and expense are involved. In addition, since each piece of property, such as a television receiver, must be associated with an individual alarm system, various logistical problems are presented. The replacement of defective or obsolete television receivers with new receivers will, for example, either require the procurement of additional alarm systems for use with the new receivers or the removal of the alarms from the old receivers and the substitution thereof on the new receivers.

SUMMARY OF THE INVENTION

To overcome the foregoing and other problems and disadvantages associated with prior art alarm systems, the alarm apparatus of the present invention makes use of a characteristic common to electrical devices such as television receivers-namely, that devices of this type are normally plugged into a wall A.C. electrical power outlet. It will be appreciated that in order to remove a television receiver from its normal location, such as by a would-by thief, the receiver must initially be unplugged from the wall outlet. By providing means in association with the wall outlet, responsive to plug removal numerous advantages over prior art alarm systems are realizable. Initially, since the alarm is directly associated with the outlet rather than the receiver, the herein described logistical problems are completely eliminated. Also, beneficial advantage can be taken of the A.C. power available at the outlet to obviate the necessity for using a self-contained power supply. Furthermore, the alarm apparatus can be made primarily responsive to mechanical forces thereby providing increased reliability and, not insignificantly, can easily be hidden from view so as to provide no obvious visual indication of the presence of an alarm. To the best of applicant's knowledge, an alarm apparatus embodying these principles is not presently known or available in the prior art.

It is in general an object of the present invention to provide an alarm apparatus for monitoring the disposition of an electrical device of the type normally plugged into a wall A.C. power outlet.

More specifically, it is a primary object of the present invention to provide an anti-theft alarm apparatus for deterring the theft of electrical devices by generating an alarm signal whenever the plug associated with the electrical device has been removed from its wall outlet.

In accordance with these and other useful objects, the alarm apparatus of the present invention essentially comprises, in combination with an electrical power receptacle, a circuit including an alarm a power source for operating the alarm whenever the circuit is closed. Also provided in association with the circuit is a switch which is responsive to at least one of the male contacts of an electrical plug mateable with the power receptacle. When the electrical plug is inserted in the power receptacle the circuit is maintained open inhibiting operation of the alarm and whenever the electrical plug is removed from the receptacle, the circuit is closed activating the alarm.

It will thereby be appreciated that, by associating the electrical plug with an electrical device such as a television receiver, means for deterring the theft of the receiver is realized. That is, by unplugging the receiver during the attempted theft thereof, the would-be thief himself operates the switch to close the circuit, thereby causing generation of the alarm. The alarm signal, which can be of numerous conventional types, indicates that an attempted theft is in progress.

DESCRIPTION OF THE PREFERRED EMBODIMENTS

Figure 1:
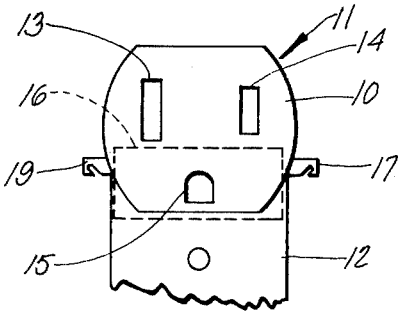
FIG. 1 is a front elevation view of one embodiment of the switching means of the present invention in association with a conventional wall A.C. electrical power outlet or receptacle.
Figure 2:
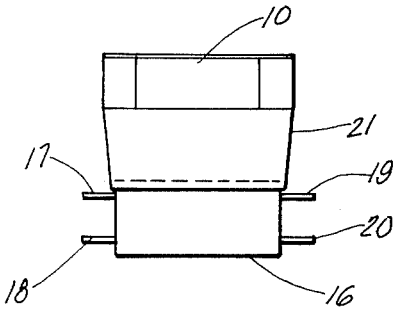
FIG. 2 is a plan view of the apparatus shown in FIG. 1.
Figure 3:
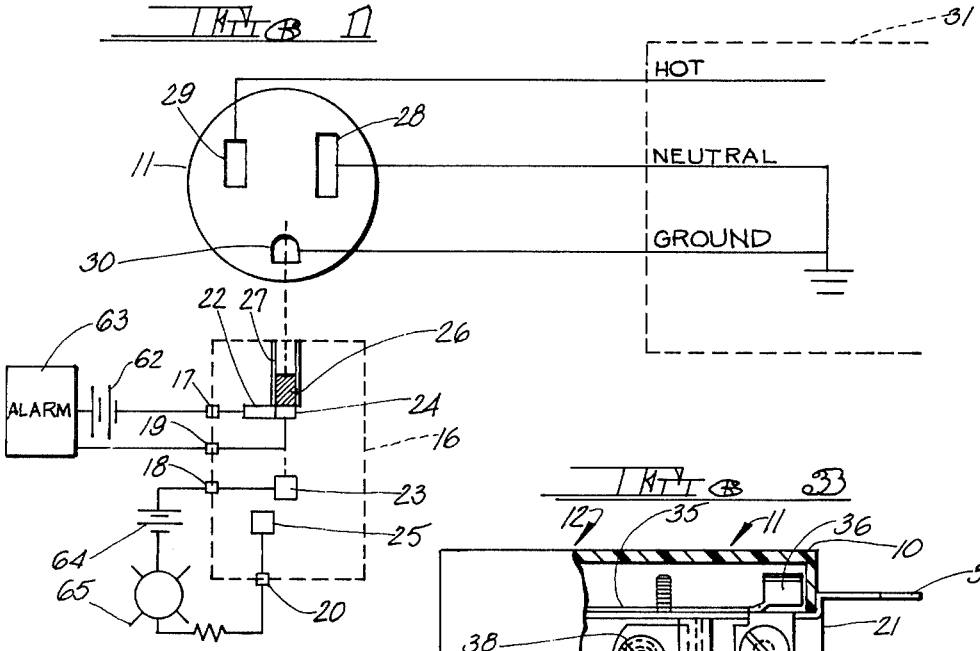
FIG. 3 is a schematic circuit diagram showing one manner of connecting an alarm circuit to the switching means shown in FIGS. 1 and 2 in accordance with the present invention.

FIGS. 1–3 show a first embodiment of the present invention. Referring to FIGS. 1 and 2, the cover plate 10 of one outlet 11 of a conventional duplex wall A.C. electrical power receptacle 12 is shown as having apertures 13, 14 and 15 for receiving, respectively, the neutral, hot and ground male blade contacts of a corresponding electrical plug. It will be appreciated that the electrical plug referred to will be associated with some electrical device such as a television receiver. A microswitch 16 having lugs 17, 18, 19 and 20 is secured to the rear of the housing 21 of outlet 11. For the purpose of an exemplary showing, microswitch 16 may be of the type manufactured by the General Electric Company under Part No. GE2332911.

Referring now to FIG. 3, internally of microswitch 16 normally closed switching contacts 22 and 24 are connected to lugs 17 and 19 respectively and normally open switching contacts 23 and 25 are connected to lugs 18 and 20 respectively. In addition, microswitch 16 includes a non-conductive push rod 26 longitudinally movable within microswitch 16 by external means for operating switching contacts 23 and 24. In this regard, push rod 26 may typically communicate with the exterior of microswitch 16 by means of a passageway 27 adapted to receive an elongated operating mechanism. Also, microswitch 16 is secured to the rear of housing 21 such that ground aperture 15 is in alignment with passageway 27 and push rod 26 whereby the ground male contact of an electrical plug may be used to reciprocate push rod 26 for operating switching contacts 23 and 24.

Referring further to FIG. 3, outlet 11 is schematically shown as including neutral, hot and ground female contacts 28, 29 and 30. It will be understood, of course, that female contacts 28, 29 and 30 underlie cover plate apertures 13, 14 and 15, respectively. It will further be understood that neutral female contact 28 and ground female contact 30 are connected to ground at panel board 31 whereas hot female contact 29 is energized by an alternating voltage supply.

In operation, an electrical plug, from a television receiver or the like, is normally inserted in outlet 11. And, when so inserted, the ground male contact of the plug communicates with and acts upon push rod 26 causing the latter to open normally closed switching contacts 22 and 24 and to simultaneously close normally open switching contacts 23 and 25. It will be noted that switching contacts 22 and 24 operatively connect a power supply 62 to an alarm circuit 63 and that switching contacts 23 and 25 similarly connect a power supply 64 to an indicating device such as the neon bulb 65. Since, as previously explained, switching contacts 22 and 24 are maintained open whenever a plug is inserted in outlet 11, alarm 63 is deactivated as long as the plug is maintained in receptacle 11. However, when the plug is removed from outlet 11, the biasing forces acting upon push rod 26 cause it to assume the position shown in FIG. 3 closing switching contacts 22 and 24. Closed switching contacts 22 and 24 cause power supply 62 to activate alarm 63 which generates an alarm signal indicating that the plug has been removed from receptacle 11. Switching contacts 23 and 25 provide convenient means for indicating the operability of the system. With the plug inserted in receptacle 11, switching contacts 23 and 25 are closed causing power supply 64 to energize neon bulb 65 thereby supplying an indication that the system is functioning properly. Upon removal of the plug from outlet 11, switching contacts 23 and 25 open (as shown in FIG. 3) deactivating neon bulb 65.

With regard to the foregoing, one important consideration concerning the design of any switching system used in combination with a power receptacle is that various safety codes provide that there shall be no switching devices in the ground circuit. It will be noted that the embodiment of the present invention described above complies with this regulation as well as the various other embodiments to be described herein.

Figure 4:
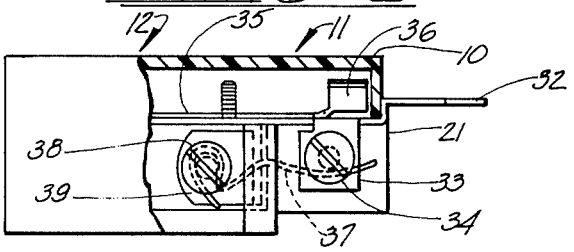
FIG. 4 is a side elevation, partially in cross section, of a second embodiment of the switching means of the present invention in association with a conventional duplex wall A.C. electrical power outlet or receptacle.
Figure 5:
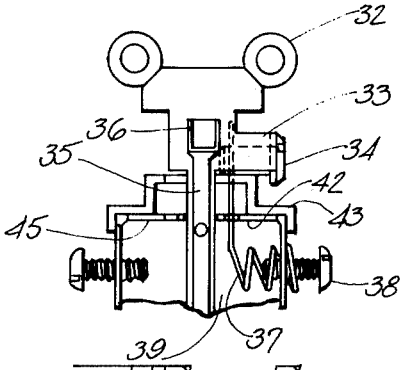
FIG. 5 is a front elevation view of the apparatus shown in FIG. 4 with the wall receptacle cover plate removed and showing only one outlet of the duplex receptacle.
Figure 6:
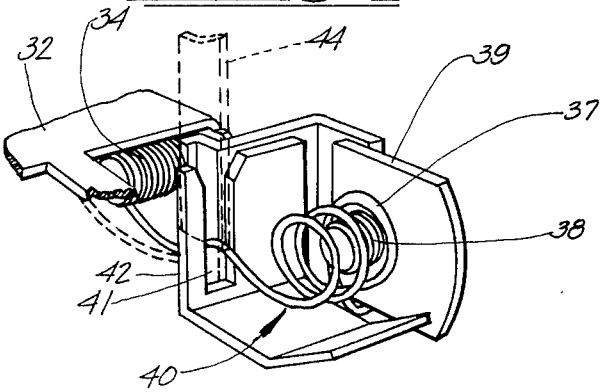
FIG. 6 is a fragmentary perspective view showing certain portions of the apparatus shown in FIGS. 4 and 5.

FIGS. 4–6 show another embodiment of the switching means of the alarm apparatus of the present invention. In this case, a duplex wall receptacle 12 having an outlet 11 and generally similar to the duplex receptacle previously described is slightly modified by the inclusion of a supplemental ground bracket 32. Supplemental ground bracket 32 includes a tab member 33 which carries an external supplemental contact screw 34. The supplemental ground bracket 32 is secured to the receptacle 12 intermediate cover plate 10 and housing 21 and makes electrical contact with the receptacle ground contact bracket 35 as well as ground female contact 36.

With further reference to FIGS. 4–6, it will be noted that a wire contact spring 37 extends from about the neutral bracket screw 38 of the neutral contact bracket 39 to a terminus normally contacting the shank of supplemental contact screw 34. In order to bias contact spring 37 to a position normally contacting the shank of supplemental contact screw 34, the portion of contact spring 37 within housing 21 is coiled into several revolutions as at 40. From the coiled portion 40, the contact spring 37 extends within the recess 41 of the neutral female contact 42 and therefrom through an aperture (not shown) in the shoulder 43 of housing 21 for contacting the shank of supplemental contact screw 34. For reasons to be described hereinafter, the contact spring 37 in the vicinity of the neutral female contact 42 is shaped to a configuration resembling an S.

With particular reference to FIG. 6, it will be appreciated that with no plug inserted in outlet 11 contact spring 37 will assume a position contacting the shank of supplemental contact screw 34 as shown by the solid line in FIG. 6. By this means, supplemental contact screw 34 is conductively connected to the neutral contact bracket 39 of the receptacle 12. However, when an electrical plug, such as from a television receiver or the like, is inserted into 11 the neutral male contact 44 thereof will force contact spring 37 out of contact with the shank of the supplemental contact screw 34 as shown by the dotted line in FIG. 6. In this condition, the supplemental contact screw 34 is disconnected from the neutral contact bracket 39 so long as the plug remains inserted in outlet 11. The previously mentioned S-shaped configuration of the contact spring 37 in the vicinity of neutral female contact 42 facilitates the action of male contact 44 upon contact spring 37.

Figure 7:
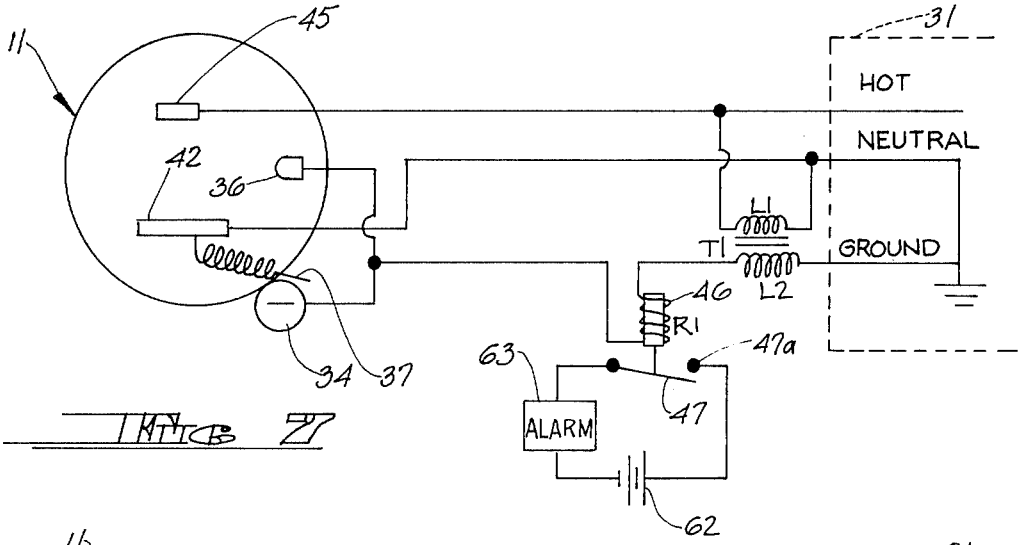
FIG. 7 is a schematic circuit diagram showing one manner of connecting an alarm circuit to the switching means shown in FIGS. 4–6 in accordance with the present invention.
Figure 8:
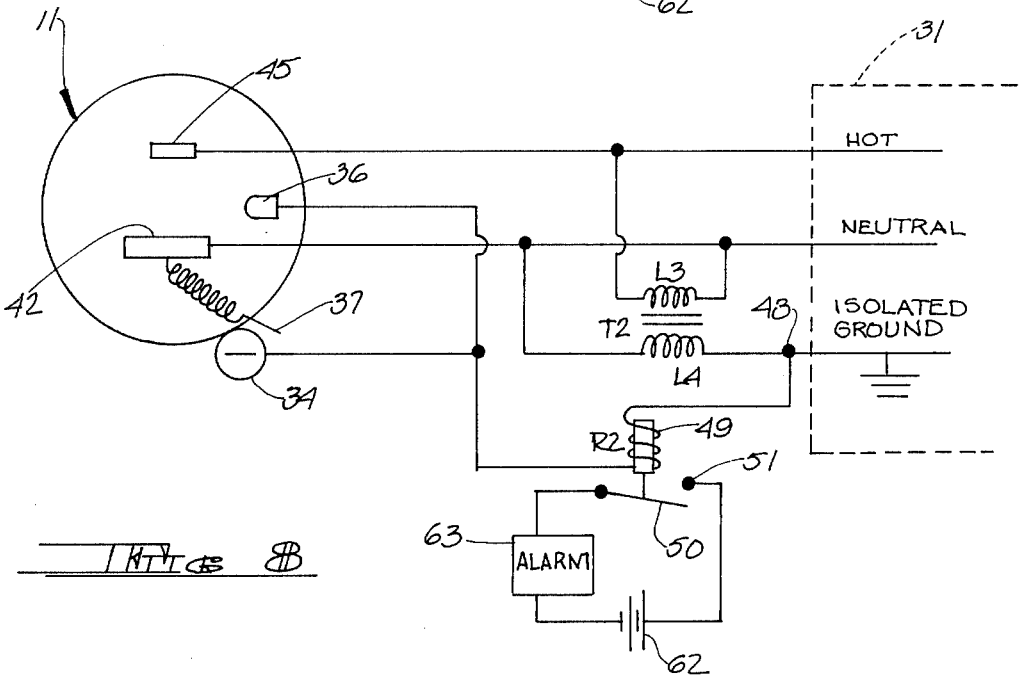
FIG. 8 is a schematic circuit diagram showing another manner of connecting an alarm circuit to the switch shown in FIGS. 4–6 in accordance with the present invention.

FIGS. 7 and 8 schematically disclose alarm circuits in accordance with the present invention for use in combination with the apparatus previously described with respect to FIGS. 4–6. The FIG. 7 embodiment is shown in combination with a power outlet 11 connected to a conventional power distribution system wherein there is provided from the panel board 31 a hot output line, a grounded neutral output line and a ground output line. The hot output line connects to the hot female contact 45, the neutral output line to the neutral female contact 42 and the ground output line to the ground female contact 36. In association with outlet 11, a transformer T1 has a primary L1 connected across the hot and neutral lines. The secondary L2 of transformer T1 is connected in the ground line and in series with the energizing winding 46 of a relay R1. The other end of the energizing winding 46 of relay R1 is connected both to supplemental contact screw 34 and ground female contact 36. Also, the pole 47 of relay R1 is connected in series with an alarm circuit having an alarm device 63 and a source of power 62.

It will be recalled that when a plug is inserted in outlet 11, contact spring 37 does not contact the supplemental contact screw 34. In this condition, the circuit containing the energizing winding 46 of relay R1 is open and the relay pole 47 assumes the position shown in FIG. 7. In this position of pole 47, the circuit containing alarm 63 is open and the alarm therefor remains dormant. However, as previously explained, upon removal of the plug from outlet 11, contact spring 37 assumes a position conductively engaging the supplemental contact screw 34. In this condition, a complete circuit is established from the secondary L2 of transformer T1 through winding 46 of relay R1 and thence to the supplemental contact screw 34. From the supplemental contact screw 34 the circuit continues through contact spring 37 and female neutral contact 42 to ground and back to the secondary L2 of transformer T1. The induced voltage in the secondary L2 of transformer T1 produces a sufficient current in the completed circuit to energize relay R1 whereby pole 47 makes contact with contact **47*a*** closing the alarm circuit to initiate the generation of an alarm signal. And, as before, it will be noticed that the continuity of the ground circuit is always maintained.

In FIG. 8, an embodiment of the present invention useful in connection with power distribution systems of the type having an isolated ground, such as frequently found in hospitals and the like, is shown. It will be appreciated that in an isolated ground system the neutral and ground lines are not grounded together. Accordingly, in FIG. 8 there is no connection between the neutral and the isolated ground line at the panel board 31.

As in the FIG. 7 embodiment, the FIG. 8 embodiment includes a transformer T2 having its primary L3 connected directly across the hot and neutral lines. One branch of the isolated ground from node 48 includes the secondary L4 of the transformer T2 which is then connected to neutral female contact 42. A second branch of the isolated ground from node 48 connects to one end of the energizing winding 49 of relay R2. The other end of winding 49 is connected to both the supplemental contact screw 34 and the female ground contact 36. Relay R2 carries a pole 50 which is disposed in a circuit containing alarm device 63 and power supply 62.

Since contact spring 37 is not in engagement with supplemental contact screw 34 in FIG. 8, it is initially assumed, as previously explained, that an electrical plug is inserted in outlet 11. Under these circumstances, the circuit containing secondary L4 and relay R2 is open so that pole 50 is positioned as shown maintaining the circuit containing alarm 63 open. Consequently, alarm 63 will remain dormant so long as the plug is maintained inserted in outlet 11. Upon removal of the plug from outlet 11, contact spring 37 engages supplemental contact screw 34 completing a circuit through secondary L4 and relay R2. The circuit extends from secondary L4 to the neutral female contact 42 and the contact spring 37. From contact spring 37 the circuit extends to supplemental contact screw 34 and therefrom through relay R2 and node 48 back to secondary L4. The induced voltage in secondary L4 produces sufficient current to energize relay R2 causing pole 50 to engage contact 51 completing the circuit through alarm 63. Alarm 63 consequently generates an alarm signal indicating that the plug has been removed from the outlet 11. Again, it will be observed that continuity is maintained in the ground circuit.

In many instances, particularly in large department stores and the like, various electrical appliances are operatively displayed by plugging the appliances into a plurality of power receptacles carried on a single power strip. The embodiment of the present invention shown in FIGS. 9 and 10 disclose means for adapting the alarm apparatus of the present invention for use in combination with a power strip of this type.

Figure 9:
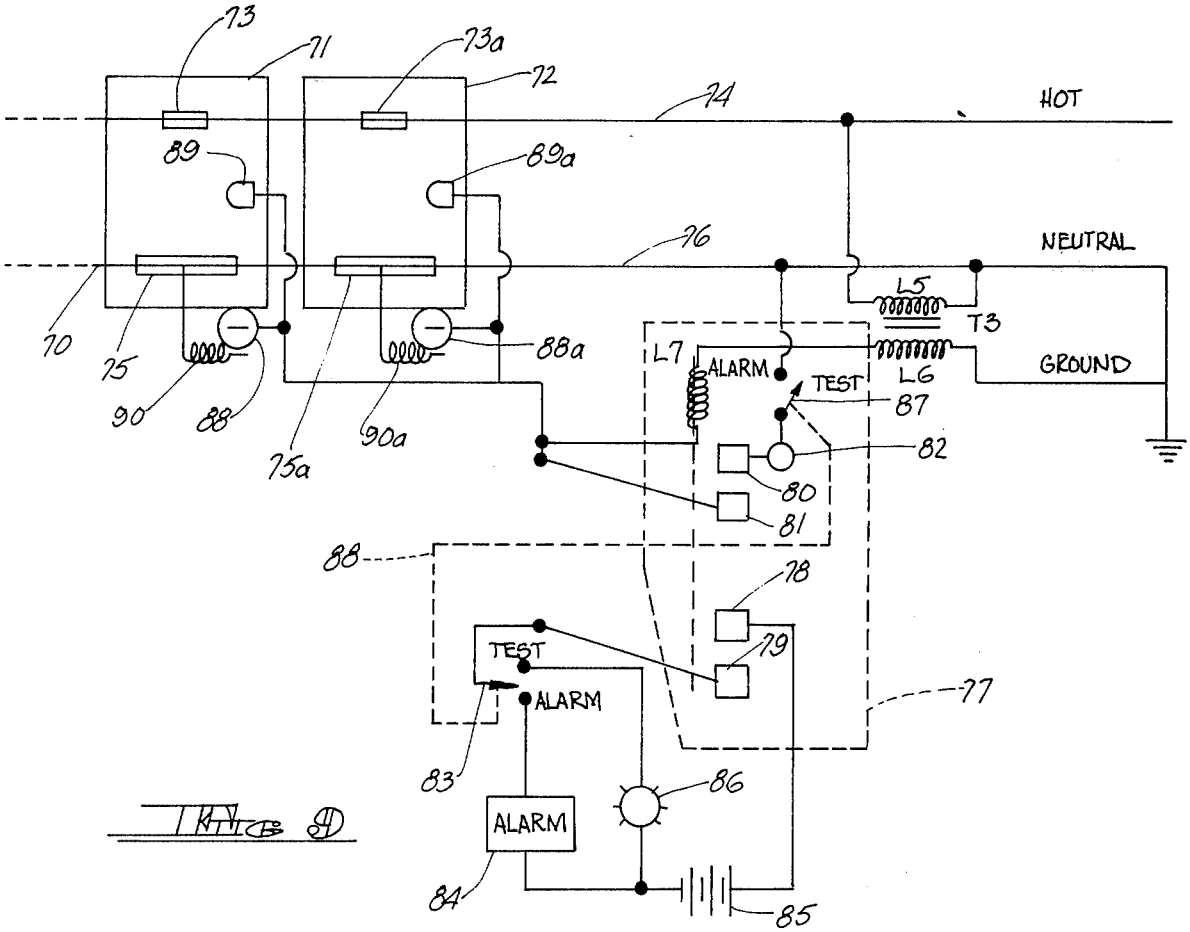
FIG. 9 is a schematic circuit diagram showing the adaptation of the switching circuit of the present invention to a power strip having a plurality of power receptacles.

Accordingly, FIG. 9 schematically shows a conventional power strip 70 having two power receptacles 71 and 72. It will be appreciated that although only two power receptacles are shown in the Figure, further receptacles similarly wired are contemplated by the invention.

Each of the power receptacles 71, 72 contains a hot female contact **73, 73*a* interconnected by a hot power bus 74 and a neutral female contact 75, 75*a* interconnected by a neutral power bus 76. In a manner similar to that shown in FIGS. 7 and 8 a transformer T3 is provided having a primary winding L5 connected between the hot and neutral power buses. The secondary winding L6 of transformer T3** is connected between facility ground and one end of the energizing winding L7 of a control relay 77. Control relay 77 includes a first pair of normally open switching contacts 78 and 79 and a second pair of normally open switching contacts 80 and 81. In addition, control relay 77 includes a spring loaded normally closed reset switch 82 which, in a conventional manner, may be manually operated to mechanically open switching contacts 78–81 whenever they are closed in response to energization of energizing winding L7.

An alarm circuit comprising manual switch 83, alarm 84 and power supply 85 is connected between switching contacts 78 and 79. It will be appreciated that when manual switch 83 is set in the ALARM position, power supply 85 will activate alarm 84 whenever switching contacts 78 and 79 are closed. Similarly, when manual switch 83 is set to the TEST position power supply 85 will activate neon bulb 86 whenever switching contact 78 and 79 are closed.

For reasons to be described more fully hereinafter, switch 87 may be provided intermediate reset switch 82 and the neutral power bus 76. As represented by dotted line 88, switch 87 is ganged with switch 83 so that when switch 83 is placed in the ALARM position, switch 87 will similarly assume the ALARM position. And, whenever switch 83 is placed in the TEST position switch 87 will also assume the TEST position.

With further reference to FIG. 9, it will be observed that energizing winding L7 and switching contact 81 of control relay 77 connect to supplemental contact screws 88 and 88*a*, as well as ground female contacts 89 and 89*a*, of power receptacles 71 and 72. Finally, momentary contact springs 90 and 90*a* extend from the neutral female contacts 75 and 75*a* of power receptacles 71 and 72 to a position in association with supplemental contact screws 88 and 88*a* respectively.

Figure 10:
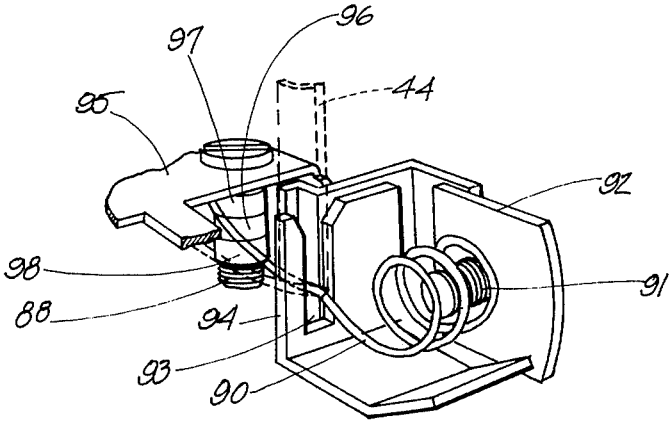
FIG. 10 is a fragmentary perspective view similar to FIG. 6 showing one embodiment of a momentary switching apparatus useful with the circuit shown in FIG. 9.

The structural interrelationship between momentary contact springs 90, 90*a* and supplemental contact screws 88, 88*a* is more clearly shown in FIG. 10. It will be appreciated that although FIG. 10 only specifically shows the relationship between the momentary contact spring 90 and the supplemental contact screw 88 associated with power receptacle 71, the corresponding elements associated with power receptacle 72, as well as any other power receptacle which may be provided by power strip 70, will be identical thereto. With this understanding, momentary contact spring 90 extends from about screw 91 mounted in neutral contact bracket 92 intermediate recess 93 of neutral female contact 94. From recess 93 the momentary contact spring 90 extends adjacent to supplemental contact screw 88 which is mounted vertically on ground bracket 95. The supplemental contact screw 88 includes three bushings mounted about the shank thereof. Central bushing 96 is a conductive metallic bushing while outer bushings 97 and 98 are non-conductive fiber bushings. When the male contact 44 of an electrical plug is inserted within recess 93 of neutral female contact 94 the momentary contact spring 90 will be depressed to the dotted line position shown in FIG. 10 contacting fiber bushing 98. It will be appreciated that while momentary contact spring 90 engages fiber bushing 98 the circuit between the supplemental contact screw 88 and the momentary contact spring 90 is maintained open. When the male contact 44 is removed from recess 93, the momentary contact spring 90 will momentarily pass over the central metallic bushing 96 and come to rest at a position engaging fiber bushing 97 as shown in solid line in FIG. 10. Therefore, upon removing male contact 44 from recess 93, the circuit between the supplemental contact screw 88 and the momentary contact spring is momentarily closed and then reopened when the male contact 44 is finally withdrawn from the recess 93. Similarly, when the male contact 44 is inserted within recess 93 the momentary contact spring is forced downward momentarily closing the circuit between the supplemental contact screw 88 and the momentary contact spring 90 until the male contact 44 is fully seated within recess 93 where the circuit is again opened. It will therefore be recognized that when either inserting or withdrawing male contact 44 from recess 93 the circuit between the supplemental contact screw 88 and the neutal female contact 94 is only momentarily closed.

Now referring back to FIG. 9, and keeping the momentary action of momentary contact spring 90 in mind, assume initially that no plugs are inserted in any of the receptacles of power strip 70. In this situation, the energizing winding L7 of control relay 77 is de-energized so that switching contacts 80, 81 and 78, 79 remain open as shown. With switching contacts 78 and 79 open neither the alarm 84 nor the neon bulb 86 can be energized.

Prior to the authorized insertion of plugs into the power receptacles of power strip 70, switches 83 and 87 are set to the TEST position. Upon insertion of the first plug into, for example, power receptacle 71, the circuit comprising secondary winding L6, energizing winding L7, supplemental contact screw 88, momentary contact spring 90, neutral female contact 75 and neutral power bus 76 is momentarily closed applying a current pulse through energizing winding L7. The current pulse momentarily closes switching contacts 80, 81 and 78, 79 causing neon bulb 86 to momentarily activate indicating that the system is operative. Upon insertion of a second plug, into power receptacle 72 for example, a current path is momentarily established between secondary winding L6, energizing winding L7, supplemental contact screw 88*a*, momentary contact spring 90*a*, neutral contact 78*a*, and neutral power bus 76. As a result, another current pulse causes energizing winding L7 to momentarily close switching contacts 78, 79 wherein neon bulb 86 is again momentarily activated showing that the system is operative. Further plugs may be inserted into the remaining power receptacles (not shown) in identical manner.

After the foregoing authorized insertion of plugs into a desired number of the power receptacles of the power strip has been completed, switches 83 and 87 are set to the ALARM position. With the circuit in this position, the removal of a plug from any one of the power receptacles of the power strip 70 will cause continuous activation of the alarm 84 as follows. For example, assume that the plug has been removed from power receptacle 71. As the plug is removed, a circuit will momentarily be established through energizing winding L7 as previously described. The current pulse through energizing winding L7 will cause both pairs of switching contacts 80, 81 and 78, 79 to momentarily close. As soon as switching contacts 80 and 81 close a circuit is established from the secondary winding L6 to the energizing winding L7 and therefrom to switching contact 81. The circuit continues from switching contact 81 through switching contact 80 and reset switch 82 back to the secondary winding L6 through the neutral power bus 76. This circuit maintains winding L7 energized and thereby latches contacts 80, 81 and 78, 79 closed. As a result, the alarm 84 will be continuously energized indicating that a plug has been removed from power strip 70. The system may be reset by activating reset switch 82 which opens switching contacts 80 and 81 removing power from energizing winding L7. It will be recognized that identical circuit action will result when a plug is removed from any of the other power receptacles on the power strip 70.

In order to prevent a would-be thief familiar with the system, such as a company employee, from disarming the alarm, the switches 83 and 87 may be located in some secure and normally inaccessible location. In this manner, the thief could not disable the alarm once it has sounded without having access to the secure location.

It is believed that the foregoing alarm apparatus represents a significant contribution to the state of the art of anti-theft alarm devices. If the apparatus is properly utilized, an alarm signal will be generated automatically whenever a would-be thief unplugs an electrical device during the perpetration of an attempted theft. The particular alarm signal could be of various types including loud horns and the like, or alternatively, remote indicating devices. In any case, the particular alarm utilized is not considered to limit the present invention.

Although the invention has been shown and described in connection with certain specific embodiments, it will be readily apparent to those skilled in the art that various changes in form and arrangement of parts may be made to suit requirements without departing from the spirit and scope of the invention. For example, although contact spring 37 as described herein is biased to normally engage the shank of supplemental contact screw 34, an alarm apparatus could also be designed wherein contact spring 37 is biased so as to normally be disengaged from the shank of supplemental contact screw 34. In this latter case, the neutral contact of the plug when inserted into outlet 11 would force contact spring 37 into engagement with supplemental contact screw 34. To implement this design, the poles 47 and 50 of relays R1 and R2 would be positioned to engage contact 47*a* and 51 when the relays are de-energized.

With the foregoing in mind, the embodiments of the invention in which an exclusive property or privilege is claimed are defined as follows:

1. An alarm circuit for electrical devices of the type normally plugged into an electrical power receptacle to provide an alarm signal whenever an electrical plug having at least hot and neutral male contacts and associated with the electrical device has been removed from said receptacle, said alarm circuit comprising:

(a) an electrical power receptacle having hot, neutral and ground female contacts adapted to be connected respectively to hot, neutral and ground conductors of an alternating current supply system, said receptacle being adapted to receive therein said plug, said hot and neutral male contacts adapted to make electrical connection respectively with said hot and neutral female contacts while said plug is inserted in said receptacle, said receptacle including switch means adapted to connect said ground conductor to said neutral conductor and being shiftable between a first switching condition for disabling said alarm circuit when said plug is inserted in said receptacle and a second switching condition for enabling said alarm circuit when said plug is removed from said receptacle, said switch means being shiftable to said first switching condition by at least one of said male contacts when received in its respective female contact, said switch means being biased to return to said second switching condition when said at least one male contact is removed from its respective female contact; and (b) an indicating circuit including a source of power operatively connected in series with said ground conductor and adapted to provide said alarm signal when said switch means is shifted to said second condition.

2. The alarm circuit according to claim 1 wherein said source of power includes a transformer having primary and secondary windings, and said indicating circuit contains a relay and an alarm device, said relay having an energizing winding and at least one pair of switching contacts, said alarm device being operatively connected to at least one of said switching contacts, said primary winding being operatively connected between said hot and neutral conductors, said secondary winding and said energizing winding being operatively connected in series with said ground conductor, whereby a current may be induced in said secondary winding and said energizing winding for operating said switching contacts to an operating position when said switch means is returned to said second condition for activating said alarm device to produce said alarm signal.

3. The alarm circuit according to claim 2 wherein said indicating circuit contains means for latching said pair of switching contacts in said operating position in response to any prior operation thereof.

4. The alarm circuit according to claim 3 wherein said indicating circuit includes means for manually energizing said relay.

5. The alarm circuit according to claim 1 wherein said ground conductor includes an isolated ground and said source of power includes a transformer having primary and secondary windings, said indicating circuit containing a relay and an alarm device, said relay having an energizing winding and at least one pair of switching contacts, said alarm device being operatively connected to at least one of said switching contacts, said primary winding being operatively connected between said hot and neutral conductors, said secondary winding being operatively connected between said neutral and isolated ground conductors, said energizing winding being operatively connected in series between said isolated ground and said female ground contact, whereby a current may be induced in said secondary and said energizing windings for operating said switching contacts to an operating position when said switch means is returned to said second condition for activating said alarm device to produce said alarm signal.

6. The alarm circuit according to claim 1 wherein said indicating circuit includes means operatively connected for testing the operativeness of said alarm circuit.

7. An electrical power receptacle for use in combination with an alarm circuit of a type having an alarm and means for operating said alarm for producing an alarm signal whenever an electric plug having at least hot and neutral male contacts associated with an electrical device has been removed from said receptacle, said receptacle comprising;

(a) hot, neutral and ground female contacts adapted to be connected respectively to hot, neutral and ground conductors of an alternating current supply system, said receptacle being adapted to receive therein said electrical plug, said hot and neutral male contacts adapted to make electrical connection respectively with said hot and neutral female contacts when said plug is inserted in said receptacle; and (b) switch means adapted to connect said ground conductor to said neutral conductor and shiftable between a first switching condition for disabling said alarm circuit when said plug is inserted in said receptacle and a second switching condition for enabling said alarm circuit when said plug is removed from said receptacle, said switch means being shiftable to said first switching condition by at least one of said male contacts when received in its respective female contact, said switch means being biased to return to said second switching condition when said at least one male contact is removed from its respective female contact.

8. The receptacle according to claim 7 wherein said switch is open in said first condition and closed in said second condition, said switch means being adapted to electrically connect said ground conductor to said neutral conductor when said switch means is returned to said second condition.

9. The receptacle according to claim 8 wherein said switch means comprises a supplemental contact operatively connected to said ground female contact and spring means operatively connected to said neutral female contact, said spring means normally contacting said supplemental contact and movable out of electrical contact with said supplemental contact by the neutral male contact of said plug when inserted in said receptacle.

10. The receptacle according to claim 7 wherein said switch means is closed in said first condition and open in said second condition, said switch means being adapted to electrically connect said ground conductor to said neutral conductor when said switch means is returned to said second condition.

11. The receptacle according to claim 10 wherein said switch means comprises a supplemental contact operatively connected to said ground female contact and spring means operatively connected to said neutral female contact, said spring means being normally biased away from said supplemental contact and movable into electrical contact with said supplemental contact by the neutral male contact of said plug when inserted in said receptacle.

12. The receptacle according to claim 7 wherein said receptacle comprises a plurality of said receptacles arranged on a power strip.

* * * * *